US005205142A

United States Patent [19]

Kruger et al.

[11] Patent Number: 5,205,142

[45] Date of Patent: Apr. 27, 1993

[54] HINGED HANDCUFFS

[75] Inventors: James B. Kruger, Oxford, Conn.; John T. Fitzpatrick, Houlton, Me.

[73] Assignee: Smith & Wesson Corp., Springfield, Mass.

[21] Appl. No.: 871,004

[22] Filed: Apr. 20, 1992

[51] Int. Cl.[5] ..... E05B 75/00

[52] U.S. Cl. ..... 70/16; 16/365

[58] Field of Search ..... 70/14–17; 16/DIG. 42, 366, 365

[56] References Cited

U.S. PATENT DOCUMENTS

| | | | |
|---|---|---|---|
| 255,809 | 4/1882 | Pfauntz | 16/366 |
| 647,735 | 4/1900 | Widmayer | 70/16 |
| 1,252,517 | 1/1918 | Walden | 70/16 |
| 1,883,502 | 10/1932 | Blake | 70/16 |
| 1,890,748 | 12/1932 | Pratt | 70/16 |
| 2,966,787 | 1/1961 | Tompkins | 70/16 |
| 3,191,218 | 6/1965 | Skiba | 16/366 |
| 3,618,345 | 11/1971 | Smith | 70/16 |
| 4,024,736 | 5/1977 | DeMichieli | 70/16 |
| 4,089,195 | 5/1978 | Lai | 70/16 |
| 4,138,867 | 2/1979 | Tompkins | 70/16 |
| 4,300,368 | 11/1981 | Sullivan | 70/16 |
| 4,684,017 | 8/1987 | Watanabe et al. | 16/366 |
| 4,697,441 | 10/1987 | Allen | 70/16 |

FOREIGN PATENT DOCUMENTS

| | | | |
|---|---|---|---|
| 363156 | 11/1922 | Fed. Rep. of Germany | 70/16 |
| 763926 | 11/1933 | France | 70/16 |
| 408270 | 12/1944 | Italy | 70/16 |
| 6808902 | 12/1969 | Netherlands | 70/16 |

*Primary Examiner*—Peter M. Cuomo
*Assistant Examiner*—Darnell Boucher
*Attorney, Agent, or Firm*—Chapin, Neal & Dempsey

[57] ABSTRACT

Disclosed is a handcuff device for restraining the wrists of a detainee. The device comprises a pair of handcuff members and a link member of unitary construction. Each of the handcuff members have one or more integrally formed mounting posts. The link member is configured to hingedly interconnect the handcuff members about the posts. The unitary construction of the link member, combined with the integrally formed posts of the handcuff members, provide a handcuff device which is strong and durable and which does not require the use of multiple components, such as a pivot pin, and substantially limits the movement of the detainees hands.

3 Claims, 3 Drawing Sheets

3-S

HINGED HANDCUFFS

BACKGROUND OF THE INVENTION

1. Field of the Invention

The present invention relates generally to hand constraint devices and more particularly, to handcuffs which are used to restrain the hands of a detainee or arrestee.

2. Background

Police officers and other law enforcement personnel frequently have the need to restrain the hand movement of persons in their custody (hereinafter "detainees" or "arrestees"). Such hand constraint devices are typically referred to as "handcuffs." Most conventional handcuff devices employ a linked chain to connect a pair of handcuffs together. One disadvantage of chain-linked handcuffs is that the detainee can manipulate the linked chain so as to twist the links. Continuous twisting of the links may cause the metal chain to fatique and break. Additionally, the flexibility of the linked chain provides the detainees with a relatively unrestricted range of movement of their hands, and in some circumstances such movement could be sufficient to enable such individuals to gain access to the lock of the handcuff which might then be picked or unlocked, if somehow a pick-type tool or key is obtained.

To overcome the disadvantages of linked chains, some law enforcement agencies have adopted a hinge type handcuff which utilizes a hinge and pivot pin construction. Several examples of handcuffs employing a hinge construction are shown in U.S. Pat. No. 2,966,787 to H. A. Tompkins and U.S. Pat. No. 3,618,345 to H. B. Smith. These patents generally disclose a hinge construction that interconnects the handcuffs which includes a pivot pin that is subject to being driven out of, or dislodged from, the hinge knuckles. Moreover, the hinged handcuffs taught by Tompkins and Smith do not prevent access to the hinge member and, as a result, the detainee or an accomplice may be able to use some type of tool, such as a small saw or bar, to break apart or destroy the hinge.

SUMMARY OF THE INVENTION

One object of the present invention is to provide an improved handcuff device which prevents the detainee from rotating his wrists.

Another object of the present invention is to provide a handcuff device which is strong and durable and which does not use pivot pins and which restricts access to the hinge member.

The present invention is embodied in a handcuff which comprises a pair of handcuff members and a unitary link member adapted such that the detained person cannot rotate his or her wrists.

The link member is of unitary construction and configured to hingedly interconnect the handcuff members. The handcuff members include one or more mounting posts integral with the construction of the handcuff members with the link member hingedly rotatable about these posts. The handcuff members are constructed such that access to the posts and/or the link members, is restricted. The link member is formed so that the handcuff members can only move in planes which are parallel to the longitudinal axis of the link member. Further, the unitary construction of the link member and the integral construction of the posts and handcuff members form hinged handcuffs that are strong and durable, do not require the use of any pivot pin, and do not allow the restrainees to rotate their wrists sufficiently to tamper with the handcuff locking mechanism.

BRIEF DESCRIPTION OF THE DRAWINGS

The preferred embodiment of the present invention will be better understood with reference to the accompanying figures in which.

DETAILED DESCRIPTION OF THE PREFERRED EMBODIMENTS

Figure 1:
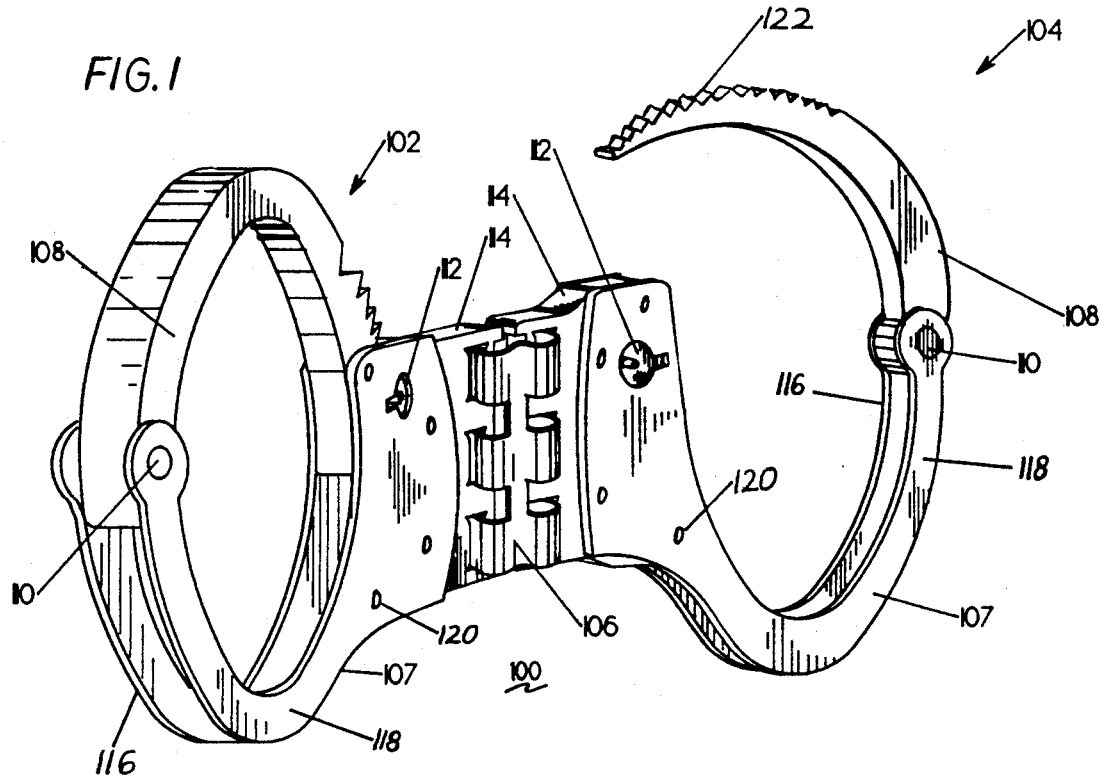
FIGS. 1 and 2 are perspective views of the handcuffs of the present invention.
Figure 2:
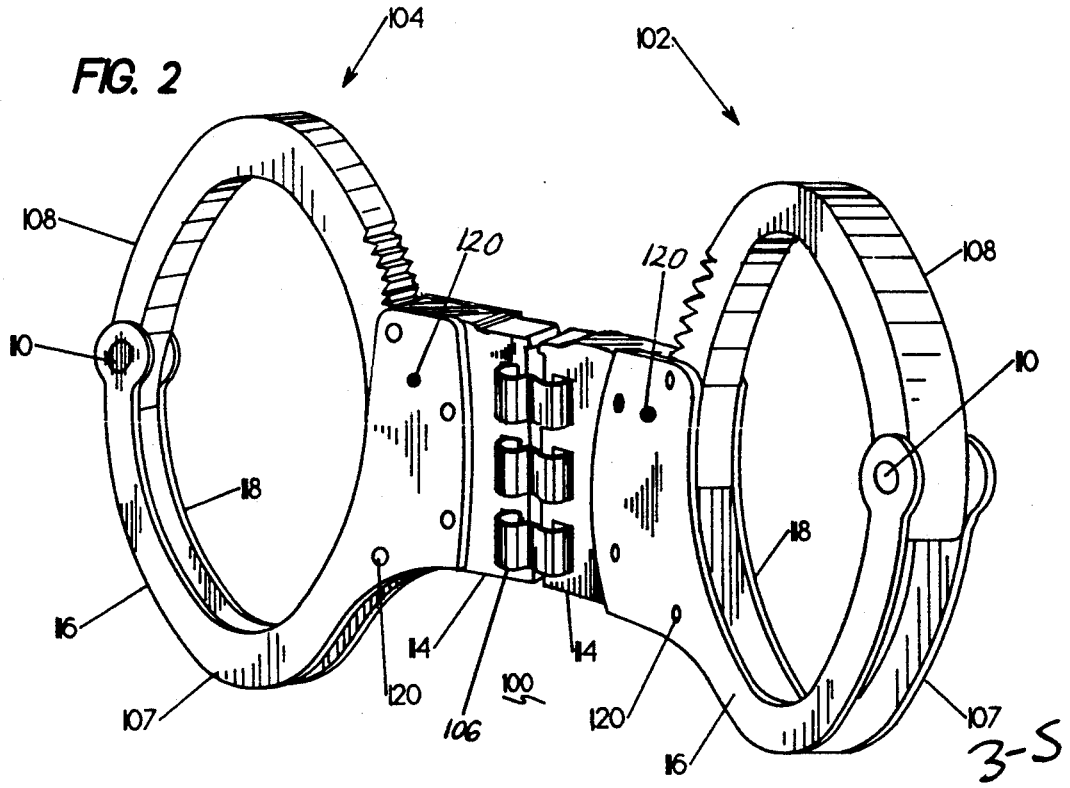

Referring to FIGS. 1 and 2, where the handcuff device 100 of the present invention is shown. Handcuff device 100 generally comprises a first handcuff member 102, a second handcuff member 104, and a unitary link member 106.

Handcuff members 102 and 104 each comprises a wrist locking means having a fixed section 107 consisting of two generally parallel spaced members 116 and 118. One end of members 116 and 118 is connected by a pivot member 110 to movable section 108. The other end of members 116 is rigidly connected to a mounting plate or flange 114 by means of fasteners 120. Movable section 108 employs a conventional "ratchet tooth" 122 and key-locking mechanism 112 to lock each of the handcuff members 102 and 104 about the wrists of the detainee.

Link member 106 is of unitary construction and securely formed about posts 308 (FIG. 3) formed integral with mounting plates 114 so as to provide a simple structure of maximum integrity and strength for hingedly interconnecting handcuff members 102 and 104, while eliminating the need for multiple components such as pivot pins found in conventional hinged handcuffs. Link member 106 is further configured to allow movement of handcuff members 102 and 104 only in a direction perpendicular to the plane of the link member 106. This feature of the present invention prevents a detainee from rotating his or her wrists and, for all practical purposes, has almost eliminated the danger of such individuals unlocking the handcuff even if an unauthorized possession of a key. This construction also overcomes the problem of fatique failures of the link member due to manipulation or twisting movements of the hands.

Figure 3:
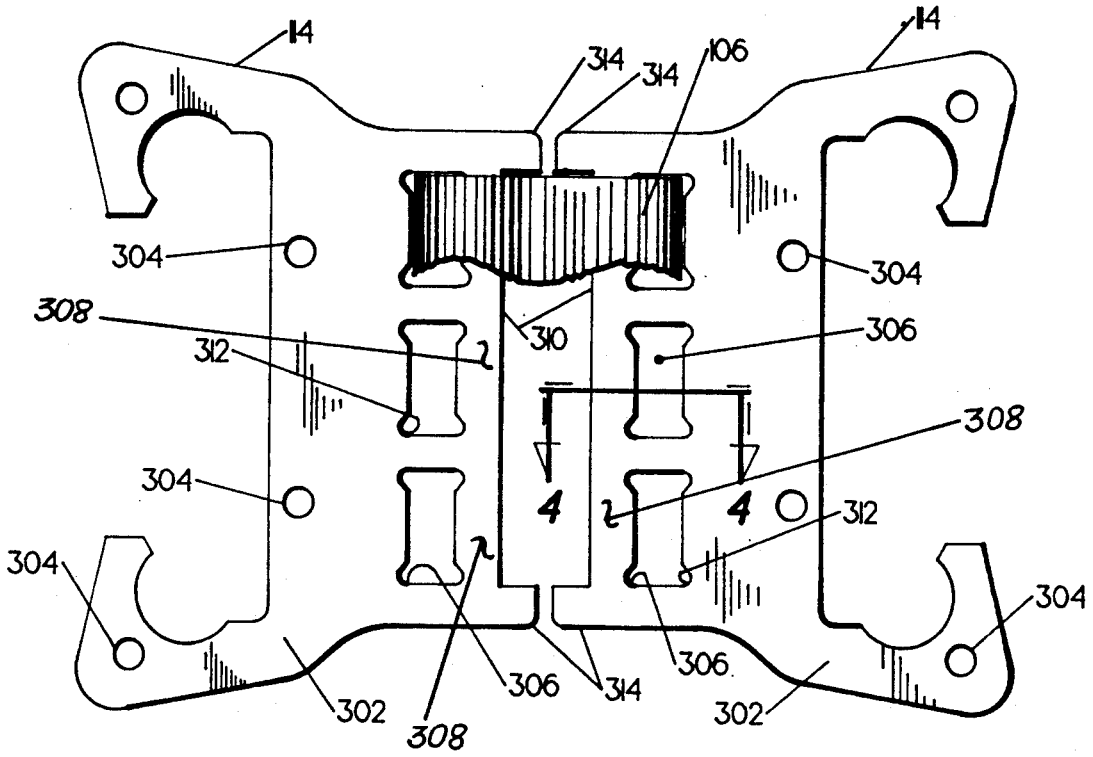
FIG. 3 is an elevational view showing the mounting plates and a partly sectioned link member.

As shown in FIG. 3, mounting plates 114 each comprise a mounting portion 302 having a plurality of openings 304 used in fastening the plates 114 between plates 116 and 118 of the fixed section 107 by fasteners 120 (FIGS. 1 and 2). Mounting plate 114 further comprises a plurality of generally rectangular cutouts or openings 306 formed along adjacent edges 310 of plates 114 when placed in juxtaposition, as in FIG. 3. The outer edge portion of each cutout 306 provide mounting posts 308 integral with mounting plate 114.

As will be more fully described herein, a plurality of fingers 504 and 504' (FIG. 5) of link member 106 are bent to form closed-loops or hinge knuckles about posts 308 and then welded to permanently fasten the free ends. Because posts 308 are formed as an integral part of mounting plate 114, they provide a strong and unitary structure for coupling with link member 106.

Openings 306 are of rectangular shape and are sized to allow the fingers 504 and 504' of link member 106 to pass therethrough. Openings 306 are formed with a radius or curved edge 312 at each corner of the openings to minimize the tendency of metal stress-fractures at these locations.

Mounting plates 114 further comprise extensions or protrusions 314 which serves, after assembly, to limit access to the posts 308 and to fingers 504 and 504' of link member 106 thereby to minimize the ability of some type of tool, such as a chisel for example, being used to cut or break the hinge member.

The thickness of mounting plate 114 is largely dependent on the desired spacing between members 116 and 118 and the desired thickness of movable section 109, but should also have adequate thickness to meet strength requirements of the hinge.

Figure 4:
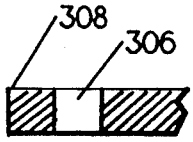
FIG. 4 is a section view taken along line 4—4 of FIG. 3.

As shown by FIG. 4, the size and/or position of openings 306 with respect to the edge of the mounting plate 114 and the thickness thereof will dictate the cross-section of post 308. As such, the size and placement of opening 306 should be chosen to ensure that each of the fingers 504 and 504' of link member 106 can be completely bent around post 308 to form a closed-loop or hinge knuckle 702, (FIG. 7) able to rotate about post 308.

Figure 5:
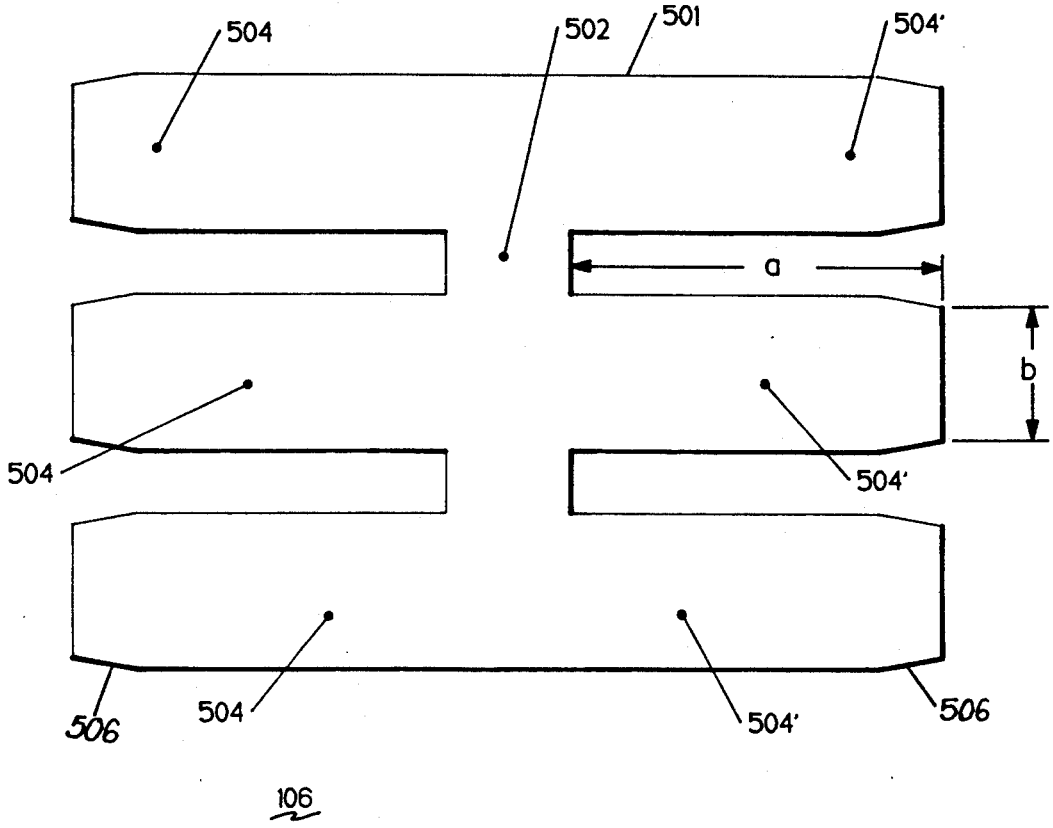
FIG. 5 is a plan view of a plate pattern that may be used in forming the link member.

Referring now to FIG. 5, where a detailed view of link-forming plate 501 used to form the link member 106 is shown. The plate 501 is a metallic member having planar configuration and comprises a spine or vane portion 502 and finger portions 504 and 504' that extend from spine portion 502. The finger portions are generally of rectangular shape and each has a transverse dimension b large enough to be of adequate strength but small enough to extend through openings 306 and of sufficient length a and flexibility to be looped completely about posts 308 of plate 114. The outer end portions of fingers 504 and 504' are tapered or beveled inwardly, as at 506, to facilitate in the assembly of the link and cuff members.

Figure 6:
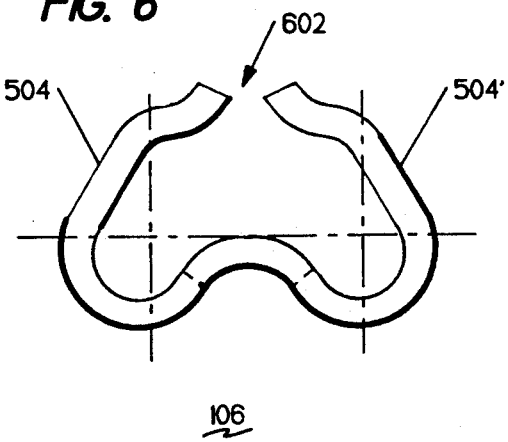
FIG. 6 is an elevational view showing an intermediate step in the forming of the link member.

Referring to FIG. 6, which shows an intermediate shape of link member 106 after the flat plate 501 undergoes a first bending process. In this intermediate position, finger portions 504 and 504' are bent upwardly and inwardly of the spine 502 to form partial loops with the free ends of fingers 504 and 504' spaced apart by a distance 602 adequate to accommodate a post 308 therebetween and to allow finger portions 504 and 504' to be readily fitted through openings 306 and about the posts 308 ready for a subsequent final bending operation.

Figure 7:
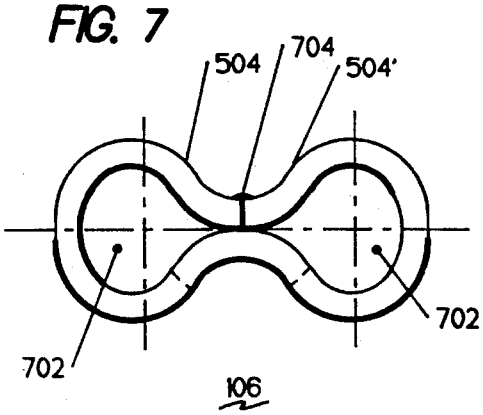
FIG. 7 is an elevational view showing the link member formed to its final shape.

Referring to FIG. 7, which shows the final shape of link member 106 after undergoing a final bending or forming operation. In this position, finger portions 504 and 504' have been bent to then final, closed-loop configuration 702. The free ends of the loops 702 are secured together and to the spine portion 502 of the link, such as by welding, as shown at 704, to thereby form hinge knuckles or closed-loops about posts 308. The exact shape of link member 106, after the final bending operation, may vary. However, it is important that fingers 504 and 504' be appropriately sized so that after application of the final bending operation, each closed-loop 702, while rotatable about its respective post 308, cannot thereafter be wedged "open" unless the weld is broken.

Link-forming member 501 and plates 114 are preferably made from AISI-1050 carbon steel and are initially cold formed in planar condition by a stamping operation without preliminary heat. After final bending of the link member onto the plate members, the handcuff assembly is heat-treated to about 2050° F. for approximately 10 minutes to relieve any stresses in the metal resulting from the manufacture thereof followed by an annealing step for 20 minutes at about 900° F.

It is contemplated that a tooling fixture be used to facilitate high production rate of the present invention. The tooling fixture may be designed in a variety of configurations but should generally be designed to operate as follows:

(a) Place link-forming member 501 onto the fixture and bend to its intermediate position (FIG. 6);

(b) With link-forming member 501 still on the fixture, assemble handcuff members 102 and 104 onto member 501 by fitting openings 306 over fingers 504 and 504', respectively;

(c) Bend member 501 to its final position to form link member 106 having closed-loops 702 about posts 308 of handcuff members 102 and 104, and (d) weld fingers 504 and 504' to each other and to spine 502 to finalize the loop portions of the hinges.

The link member is preferably formed with sets of at least three (3) fingers to limit access by a cutting tool to the middle loop 702 and the central hinge post 308.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device for restraining the hands of a person comprising first and second handcuff members and a link member configured to hingedly connect said first handcuff member to said second handcuff member, said first and second handcuff members each comprise a mounting plate having at least one post member integral to said mounting plate, said link member comprises a spine portion having a plurality of fingers which extend oppositely from said spine portion and forming substantially closed loops disposed abut each post member to hingedly interconnect said handcuff members together.

2. The device of claim 1, wherein said link member is of one piece construction.

3. The device of claim 2, wherein each of said mounting plates comprises a protrusion disposed and configured to limit access to said link member after assembly to said mounting plates.

* * * * *